US010406651B2

(12) United States Patent
Tan et al.

(10) Patent No.: US 10,406,651 B2
(45) Date of Patent: Sep. 10, 2019

(54) METHODS OF VIBRO-TREATING AND VIBRO-TREATING APPARATUS

(71) Applicants: ROLLS-ROYCE plc, London (GB); ROLLS-ROYCE DEUTSCHLAND LTD & CO KG, Blankenfelde-Mahlow, Dahletwitz (DE)

(72) Inventors: Cheng Cheh Tan, Singapore (SG); Chow Cher Wong, Singapore (SG); Harsh Gupta, Singapore (SG); Goetz G Feldmann, Oberursel (DE); Thomas Haubold, Wehrheim (DE); Paul Barrowman, Otley (GB)

(73) Assignees: ROLLS-ROYCE plc, London (GB); ROLLS-ROYCE DEUTSCHLAND LTD & CO KG, Dahlewitz (DE)

( * ) Notice: Subject to any disclaimer, the term of this patent is extended or adjusted under 35 U.S.C. 154(b) by 264 days.

(21) Appl. No.: 15/470,293

(22) Filed: Mar. 27, 2017

(65) Prior Publication Data

US 2017/0282323 A1 Oct. 5, 2017

(30) Foreign Application Priority Data

Apr. 1, 2016 (GB) ..... 1605566.7

(51) Int. Cl.
*B24B 31/06* (2006.01)
*F01D 5/02* (2006.01)
(Continued)

(52) U.S. Cl.
CPC ..... *B24B 31/062* (2013.01); *B24B 19/14* (2013.01); *B24B 31/003* (2013.01);
(Continued)

(58) Field of Classification Search
CPC ..... B24B 31/062; B24B 31/064; B24B 31/12; B24B 31/003; B24B 19/14
(Continued)

(56) References Cited

U.S. PATENT DOCUMENTS 2,372,723 A * 4/1945 Jasper ..... B23K 31/02 220/586
3,371,449 A 3/1968 Olson et al.
(Continued)

FOREIGN PATENT DOCUMENTS

DE 102009021824 A1 11/2010
DE 102013107494 A1 1/2015
(Continued)

OTHER PUBLICATIONS

Aug. 8, 2017 European Search Report issued in Patent Application No. EP17163023.
(Continued)

*Primary Examiner* — George B Nguyen
(74) *Attorney, Agent, or Firm* — Oliff PLC

(57) ABSTRACT

A method and apparatus for vibro-treating an object. The method includes the steps of controlling a relative displacement between a vibro-treating media and a surface area of the object to provide a vibro-treating effect; and, controlling movement of the object relative to a surface of the vibro-treating media while controlling relative displacement between the vibro-treating media and the surface area of the object, according to one or more pre-determined conditions, to provide a substantially even vibro-treating condition over the surface area of the object.

20 Claims, 5 Drawing Sheets

(51) Int. Cl.

| | |
|---|---|
| ***F04D 29/32*** | (2006.01) |
| ***B24B 19/14*** | (2006.01) |
| ***B24B 31/00*** | (2006.01) |
| ***B24B 31/12*** | (2006.01) |
| ***F01D 5/28*** | (2006.01) |

(52) U.S. Cl.
CPC ..... *B24B 31/064* (2013.01); *B24B 31/12* (2013.01); *F01D 5/02* (2013.01); *F01D 5/286* (2013.01); *F04D 29/324* (2013.01); *F04D 29/325* (2013.01); *F05D 2220/32* (2013.01); *F05D 2230/90* (2013.01); *F05D 2300/17* (2013.01)

(58) Field of Classification Search
USPC ..... 451/29, 104, 326–330
See application file for complete search history.

(56) References Cited

U.S. PATENT DOCUMENTS

| | | | | |
|---|---|---|---|---|
| 3,464,163 | A | 9/1969 | Ferrara | |
| 5,125,191 | A * | 6/1992 | Rhoades | B24B 1/00 451/113 |
| 5,271,184 | A * | 12/1993 | Majors | B24B 31/064 451/106 |
| 6,960,116 | B2 * | 11/2005 | McNeil | B24B 31/003 451/104 |
| 6,962,522 | B1 * | 11/2005 | Kawasaki | B24B 31/003 451/104 |
| 7,063,594 | B1 * | 6/2006 | Engin | B24B 3/02 451/104 |
| 8,062,094 | B2 * | 11/2011 | Cisek | B23P 9/00 451/33 |
| 8,105,133 | B2 * | 1/2012 | Jayabalan | B24B 19/14 118/301 |
| 8,151,613 | B2 * | 4/2012 | Ishikura | B24C 1/086 72/53 |
| 9,751,187 | B2 * | 9/2017 | Beckman | C21D 7/06 |
| 2001/0007811 | A1 * | 7/2001 | Kawasaki | B24B 31/003 451/104 |
| 2005/0136802 | A1 * | 6/2005 | Rudiger | B24B 31/003 451/36 |
| 2009/0314758 | A1 * | 12/2009 | Ganesh | B23K 9/04 219/137 R |
| 2011/0109029 | A1 * | 5/2011 | Takeda | B05B 13/0264 269/8 |
| 2013/0139852 | A1 * | 6/2013 | Pillhoefer | B24C 1/086 134/7 |
| 2015/0038054 | A1 * | 2/2015 | Tomita | B24B 31/033 451/32 |

FOREIGN PATENT DOCUMENTS

| | | | | |
|---|---|---|---|---|
| EP | 0161260 | A1 * | 11/1985 | B22D 29/005 |
| GB | 1067656 | A | 5/1967 | |
| GB | 2058621 | A | 4/1981 | |
| WO | 85/02136 | A1 | 5/1985 | |
| WO | 2010/139468 | A1 | 12/2010 | |

OTHER PUBLICATIONS

Sep. 21, 2016 Search Report issued in British Patent Application No. 1605566.7.

* cited by examiner

METHODS OF VIBRO-TREATING AND VIBRO-TREATING APPARATUS

FIELD

The present disclosure relates to vibro-treating processes and apparatus.

BACKGROUND

Vibro-treating is a process for the surface improvement of metallic objects. For example, vibropolishing, also known as vibratory finishing, is commonly used to deburr, radius, descale, burnish, clean and brighten objects or parts of substantial hardness which require such surface improvement.

In vibropolishing, specially selected pellets, shot or tokens of media of a particular geometry and/or hardness are placed into an appropriately sized container. Objects requiring treatment are added to, or suspended within media contained within the container before the contents are vibrated. In the process of moving or vibrating the media relative to the object, or vice versa, the media rubs exposed areas of the object, causing a localised material removal from the tips of any outwardly extending asperities, so smoothing the surface of the object. As such, the media may also interact with internal features, such as holes or recesses, where active movement of media through the object is possible.

In use, such a rubbing or cutting action allows vibropolishing to produce an essentially smooth surface finish, bought about by what may be described as a substantial lapping action. Due to the fact that the bowl and object move as a substantially combined unit, fragile or delicate parts are supported by the media immediately surrounding the object, so making vibropolishing suitable for a wide range of delicate applications where improvement of surface finish is required.

However, there are a number of associated problems or known disadvantages with the presently available methods of vibropolishing which render the process unsuitable for certain applications. Accordingly, a fixed process, wherein items are held by a fixture and lowered into the media for treatment, only allows a specific number of objects to be attached to the fixture. Additionally, the fixed process and requires a large amount of processing time in order to mask objects, clamp objects and subsequently remove objects from the fixture, leading to reduced efficiency for a large number of small objects requiring treatment. For this reason, the fixed process is predominantly associated with the treatment of large aerospace objects.

In a separate surface improvement process, shot peening provides a means of cold working a surface of an object. This provides a compressive residual stress layer on the surface of a given object thus modifying the mechanical properties of the metals. The process of shot peening involves impacting a surface with metallic, glass, or ceramic shot with force sufficient to create a plastic deformation, thus imparting a layer of compressive residual stress.

In particular, vibropeening processes have been developed which provide an alternative to the combined processes of shot-peening and vibropolishing. In particular, vibropeening employs the inertia of heavier media to impart the required compressive residual stress onto the fan blade or aerofoil whilst concurrently smoothing the object and/or bringing about a material removal. Using the above method, the processing of a single object allows the ability to accurately control the application time and process parameters experienced by the object. This limits the output of a given machine and thus inhibits the cost performance of the vibropeening process. However, vibropeening also provides a number of disadvantages, including disprortionate vibropeening effect in different areas of the vibropeening container, leading to parts often receiving non-equivalent surface treatments.

SUMMARY

According to various examples, there is provided a method of vibro-treating an object, the method comprising: controlling a relative displacement between a vibro-treating media and a surface area of the object to provide a vibro-treating effect; and, controlling movement of the object relative to a surface of the vibro-treating media whilst controlling the relative displacement between the vibro-treating media and the surface area of the object, according to one or more pre-determined conditions, to provide a substantially even vibro-treating condition over the surface area of the object.

Thus, in this way, the method provides the ability to vibro-treat an object during one or more of insertion and withdrawal of the object from the vibro-treating media. This is made possible through one or more of insertion and withdrawal of the object according to a pre-determined condition. Thus, insertion and/or withdrawal ensures that the entire area to be treated is provided with a substantially even vibro-treating condition. This is due, in part, to research establishing that the most intense vibro-treating conditions are found in the region immediately adjacent to the surface of the vibro-treating media. As such, it has also been found that vibro-treating intensity reduces as a function of depth of media, relative to the surface of the vitro-treating media. This effect may be more or less pronounced depending on one or more of, for example, the shape, size or depth of the container comprising the vitro-treating media, the location of the agitator, or the wall distance between the component, container, or fixture, inserting and/or withdrawing the object into and/or from the vibro-treating media thus ensures that the entire area to be treated passes through the region immediately adjacent the surface of the vitro-treating media for a predetermined period of time in accordance with the predetermined conditions.

Thus, in this way, the process of vitro-treating may provide a vibropeening effect. The vibro-treating effect may impart a layer of compressive residual stress onto the surface area of the object. The vitro-treating effect may improve the surface area of the object exposed to the media. The vibro-treating effect may simultaneously impart a layer of compressive residual stress onto the surface area of the object and improve both of the surface area of the object exposed to the media. By improving or refining the surface(s) of the object exposed to the media, the surface roughness of an outer surface of the object exposed to the media may be at least partially reduced relative to the surface roughness of the outer surface of the object prior to vitro-treating. Additionally or alternatively, by improving or refining the surface (s) of the object exposed to the media, either or both of a peak height or valley depth of an asperity or valley may be at least partially reduced relative to the peak height or valley depth prior to vitro-treating. Additionally or alternatively, by improving or refining the surface(s) of the object exposed to the media, a radius of an edge feature or a radius of an asperity or valley upon the surface may be at least partially increased relative to the radius of the edge feature, asperity or valley prior to vibro-treating.

In this way, a substantially even vitro-treating condition may be provided over the surface area of the object. The substantially even vitro-treating condition may refer to a predetermined coverage. The predetermined coverage may refer to the percentage of the surface area of the object that has been vitro-treated according to a pre-determined condition. The substantially even vitro-treating condition may refer to a predetermined intensity.

Shot peening saturation may defined as the point on a curve of peening time versus arc height beyond which the arc height increases by less than 10% when the peening time doubles. Hence, the saturation time may be a measure of process time required to reach shot peening saturation. The intensity may be a measure of the shot blast stream energy. The Almen intensity, or peening intensity, may be the arc height of the Almen strip at shot peening saturation. In some examples, the intensity may be proportional to mass and velocity of the shot. The intensity may be, for example, the arc height of an Almen test strip measured at a coverage of 98% using an Almen gauge.

Optionally, at least one of the pre-determined conditions may determine a rate of movement of the object relative to the surface of the vibro-treating media.

Thus, in this way, rate of movement of the object may represent, for example, a factor of displacement relative to the surface of the vibro-treating media per unit of time. The pre-determined condition may vary according to one or more of vibration frequency, amplitude and location within the container. Alternatively, the pre-determined condition may vary according to one or more of, for example, media selection, size, shape and/or number of objects for treatment, the size and/or depth of container and time periods held at specific locations relative to the surface of the vibro-treating media. Separately, or in conjunction with any one or more of the above, the pre-determined condition may vary according to one or more factors such as, for example, material or vibro-treating requirements such as coverage, intensity, material removal or required surface finish properties.

Optionally, the rate of movement of the object relative to the surface of the vibro-treating media may be continuous.

Optionally, the rate of movement of the object relative to the surface of the vibro-treating media may be discontinuous.

Thus, in this way, the movement of the object into or out of the vibro-treating media may be a substantially continuous or discontinuous movement. Such movement may be provided, for example, as one or more steps of proportionate or disproportionate magnitude. Thus, the treatment may comprise treating the object for a set period of time at a set treatment position within the vibro-treating media, before moving the object to a following treatment position within the container. Alternatively, the treatment may comprise a substantially smooth movement.

Optionally, controlling movement of the object relative to the surface of the vibro-treating media may comprise at least partially inserting the surface area of the object within the vibro-treating media.

Optionally, controlling movement of the object relative to the surface of the vibro-treating media may comprise at least partially withdrawing the surface area of the object from the vibro-treating media.

Thus, in this way, the process advantageously allows the option for specified one or more parts, regions, edges or surfaces of the object to be treated during a given treatment stage by only partial immersion within the vibro-treating media. Thus, it may be possible to treat only a part of the object without fully immersing it within the vibro-treating media. It will be appreciated that the method may thus accommodate a wide range of object sizes and shapes. Pre-determined treatment conditions may thus be tailored to suit, for example, one or more of a given size, shape, material and vibro-treating requirement for a pre-specified object.

Optionally, the object may be inserted and/or withdrawn from the vibro-treating media over a time period of between about 0.1 to 5 times the saturation time of the object. Optionally, the object may be inserted and/or withdrawn from the vibro-treating media over a time period of between about 0.5 to 3 times the saturation time of the object. Optionally, the object may be inserted and/or withdrawn from the vibro-treating media over a period of between about 1 to 2 times the saturation time of the object.

Thus, in this way, the object may receive a variety of vibro-treating treatments, according to material and/or process requirements. Thus, treatments may include multiple part, or stepped treatments in one or more of the surface areas according to one or more pre-determined conditions. Thus, the object may be withdrawn from the vibro-treating media before the process has completed, and either reinserted to treat a part, for example, for a remainder of the processing condition and/or to provide a further treatment at a further location according to a further pre-determined condition. In this way, the multiple part, or stepped treatments may comprise two or more distinct process steps, Optionally, the method may further comprise masking at least a portion of the object to substantially prevent interaction of the vibro-treating media with the surface of the object within the masked surface area.

Thus, in this way, only a required part, region, edge or surface of the object may be treated during a given treatment stage despite either full or partial immersion within the vibro-treating media. This is due, in part, to a maskant or cover being placed on or around the object so as to protect predetermined locations from media interaction. Thus, in this way, an object may receive one or more different treatments in different locations due to successive maskant and treatment stages. Alternatively, sensitive, damage intolerant or locations not requiring treatment may not be contacted or treated by the vibro-treating media despite being immersed within the vibro-treating media during treatment of the non-masked or unprotected areas.

Optionally, controlling movement may comprise controlling movement of the object relative to the surface of the vibro-treating media at an angle approximately normal to the surface of the vibro-treating media.

Thus, in this way, the object may be raised or lowered into the vibro-treating media whilst in a substantially vertical orientation. Raising or lowering the object whilst in this orientation ensures that lateral forces acting on the object during insertion or removal are minimised. This ensures that stresses acting on the fixturing and supporting infrastructure are minimised. Additionally, lowering the object whilst in this position allows the weight of the object to assist in its insertion into the vibro-treating media. Furthermore, orientating the object in this manner also minimises the frictional forces acting upon the object during insertion and/or removal. Holding the object at an angle approximately normal to the surface of the vibro-treating media also minimises the footprint of the object relative to the vibro-treating media, ensuring that either the maximum number of objects may be inserted within the container at a given time, or the diameter of the container may be reduced. Alternatively, the object may be raised or lowered into the vibro-treating media at an at least partially angled orientation relative to the surface of the vibro-treating media. Such orientation of the object may be used as an alternative to masking, so that vibro-treating media only interacts with areas of the object which have been lowered into, or are accessible to the vibro-treating media.

It will also be appreciated that the object may be treated during one or more of whilst being lowered into the vibro-treating media, whilst being held within the vibro-treating media, or whilst being raised from the vibro-treating media.

It will also be appreciated that whilst the object may be raised from or lowered into the vibro-treating media whilst in a substantially vertical orientation, further fixturing locations or object orientations may be possible. Orientation may be altered either during or following insertion and/or removal from the vibro-treating media.

Optionally, the object may have an axis and controlling movement may comprise controlling the rotation of the object about the axis of the object.

Thus, in this way, a twisting of the object during one or more of insertion, treatment or removal may aid in the insertion or removal of the object relative to the vibro-treating media. Additionally or alternatively, a twisting of the object during one or more of insertion, treatment or removal may aid in stirring the vibro-treating media. A stirring of the media may provide a movement of the vibro-treating media relative to the object during treatment so as agitate the media. A movement of the vibro-treating media relative to the object during treatment may also add to the vibro-treating effect according to the pre-determined condition.

It will be appreciated that, in one example, the vibro-treating media may be caused to impact on and move around the object during treatment, hence maintaining circulation of vibro-treating media around the object during use. This circulation seeks to prevent local media being continually used and becoming overly worn or damaged by the process, thus maintaining process efficiency.

Optionally, the object may comprise a metal or alloy.

Thus, in this way, the removal time according to the predetermined condition may vary with material, each material requiring a variable vibro-treating intensity and/or coverage condition. Thus, the removal time may vary according to one or more of vibro-treating intensity and coverage, or any such further material property as required.

Optionally, the object may be one or more of an aerofoil, blade, disc, drum, bladed disc, bladed drum, ring or bladed ring.

Thus, in this way, the process may be used for the preparation and/or vibro-treatment of aerospace objects.

According to various examples, there is provided a vibro-treating apparatus comprising a controller configured to: control a relative displacement between a vibro-treating media and a surface area of an object to provide a vibro-treating effect; and, control movement of the object relative to a surface of the vibro-treating media whilst controlling the relative displacement between the vibro-treating media and the surface area of the object, according to one or more pre-determined conditions, to provide a substantially even vibro-treating condition over the surface area of the object.

Optionally, the apparatus may comprise a fixture configured to position the object relative to the surface of the vibro-treating media. The fixture may be a support structure.

Optionally, the fixture may be configured to alter the position of the object relative to the surface of the vibro-treating media whilst vibro-treating.

Optionally, the fixture may be configured to hold a plurality of objects.

Optionally, at least one of the pre-determined conditions may determine a rate of movement of the object relative to the surface of the vibro-treating media.

Optionally, the rate of movement of the object relative to the surface of the vibro-treating media may be continuous.

Optionally, the rate of movement of the object relative to the surface of the vibro-treating media may be discontinuous.

Optionally, controlling the movement of the object relative to the surface of the vibro-treating media may comprise at least partially inserting the surface area of the object within the vibro-treating media.

Optionally, controlling the movement of the object relative to the surface of the vibro-treating media may comprise at least partially removing the surface area of the object from the vibro-treating media.

Optionally, the object being moved relative to the vibro-treating media over a time period of between about 0.1 to 5 times the saturation time of the metal or alloy. Optionally, the object being moved relative to the vibro-treating media over a time period of between about 0.5 to 3 times the saturation time of the metal or alloy. Optionally, the object being moved relative to the vibro-treating media over a period of between about 1 to 2 times the saturation time of the metal or alloy.

Optionally, the vibro-treating apparatus may further comprise masking at least a portion of the surface area of the object to substantially prevent interaction of the vibro-treating media with the surface of the object within the masked surface area.

Optionally, controlling movement may include controlling movement of the object relative to the surface of the vibro-treating media at an angle approximately normal to the surface of the vibro-treating media.

Optionally, the object may have an axis and controlling movement may comprise controlling the rotation of the object about the axis of the object.

Optionally, the object may comprise a metal or alloy.

Optionally, the object may be one or more of an aerofoil, blade, disc, drum, bladed disc, bladed drum, ring or bladed ring.

According to various examples, there is provided a computer program that, when read by a computer, causes performance of the hereinbefore described method.

According to various examples, there is provided a non-transitory computer readable storage medium comprising computer readable instructions that, when read by a computer, cause performance of the hereinbefore described method.

According to various examples, there is provided a signal comprising computer readable instructions that, when read by a computer, cause performance of the hereinbefore described method.

The skilled person will appreciate that except where mutually exclusive, a feature described in relation to any one of the above aspects may be applied mutatis mutandis to any other aspect. Furthermore except where mutually exclusive any feature described herein may be applied to any aspect and/or combined with any other feature described herein.

BRIEF DESCRIPTION

Embodiments will now be described by way of example only, with reference to the Figures, in which.

DETAILED DESCRIPTION

In the following description, the terms 'connected' and 'coupled' mean operationally connected and coupled. It should be appreciated that there may be any number of intervening objects between the mentioned features, including no intervening objects.

Figure 1:
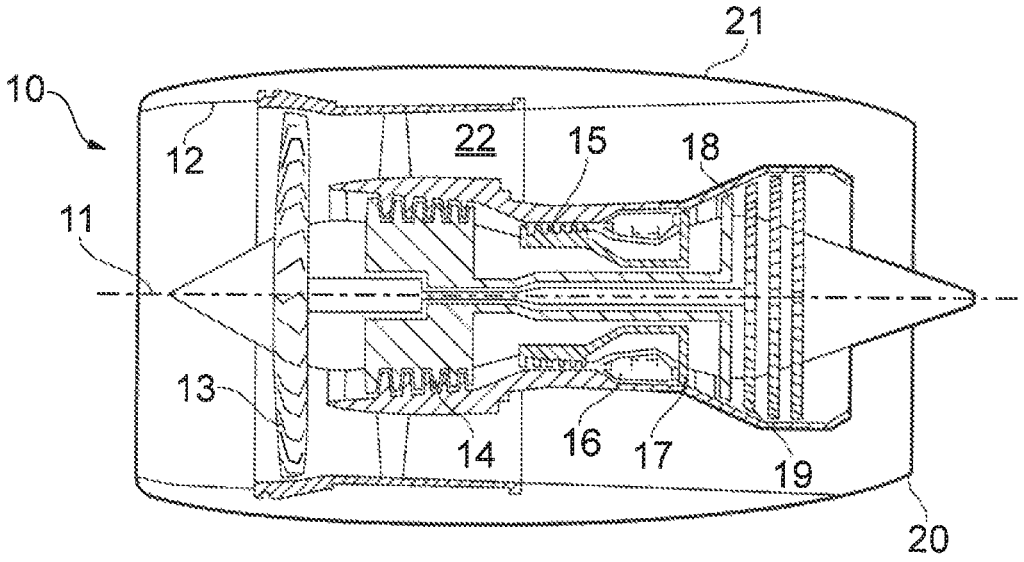
FIG. 1 illustrates a cross sectional side view of a gas turbine engine according to various examples.

With reference to FIG. 1, a gas turbine engine is generally indicated at 10, having a principal and rotational axis 11. The engine 10 comprises, in axial flow series, an air intake 12, a propulsive fan 13, an intermediate pressure compressor 14, a high-pressure compressor 15, combustion equipment 16, a high-pressure turbine 17, an intermediate pressure turbine 18, a low-pressure turbine 19 and an exhaust nozzle 20. A nacelle 21 generally surrounds the engine 10 and defines both the intake 12 and the exhaust nozzle 20.

The gas turbine engine 10 works in the conventional manner so that air entering the intake 12 is accelerated by the fan 13 to produce two air flows: a first air flow into the intermediate pressure compressor 14 and a second air flow which passes through a bypass duct 22 to provide propulsive thrust. The intermediate pressure compressor 14 compresses the air flow directed into it before delivering that air to the high pressure compressor 15 where further compression takes place.

The compressed air exhausted from the high-pressure compressor 15 is directed into the combustion equipment 16 where it is mixed with fuel and the mixture combusted. The resultant hot combustion products then expand through, and thereby drive the high, intermediate and low-pressure turbines 17, 18, 19 before being exhausted through the nozzle 20 to provide additional propulsive thrust. The high 17, intermediate 18 and low 19 pressure turbines drive respectively the high pressure compressor 15, intermediate pressure compressor 14 and fan 13, each by suitable interconnecting shaft.

Other gas turbine engines to which the present disclosure may be applied may have alternative configurations. By way of example such engines may have an alternative number of interconnecting shafts (e.g. two) and/or an alternative number of compressors and/or turbines. Further the engine may comprise a gearbox provided in the drive train from a turbine to a compressor and/or fan.

Figure 2:
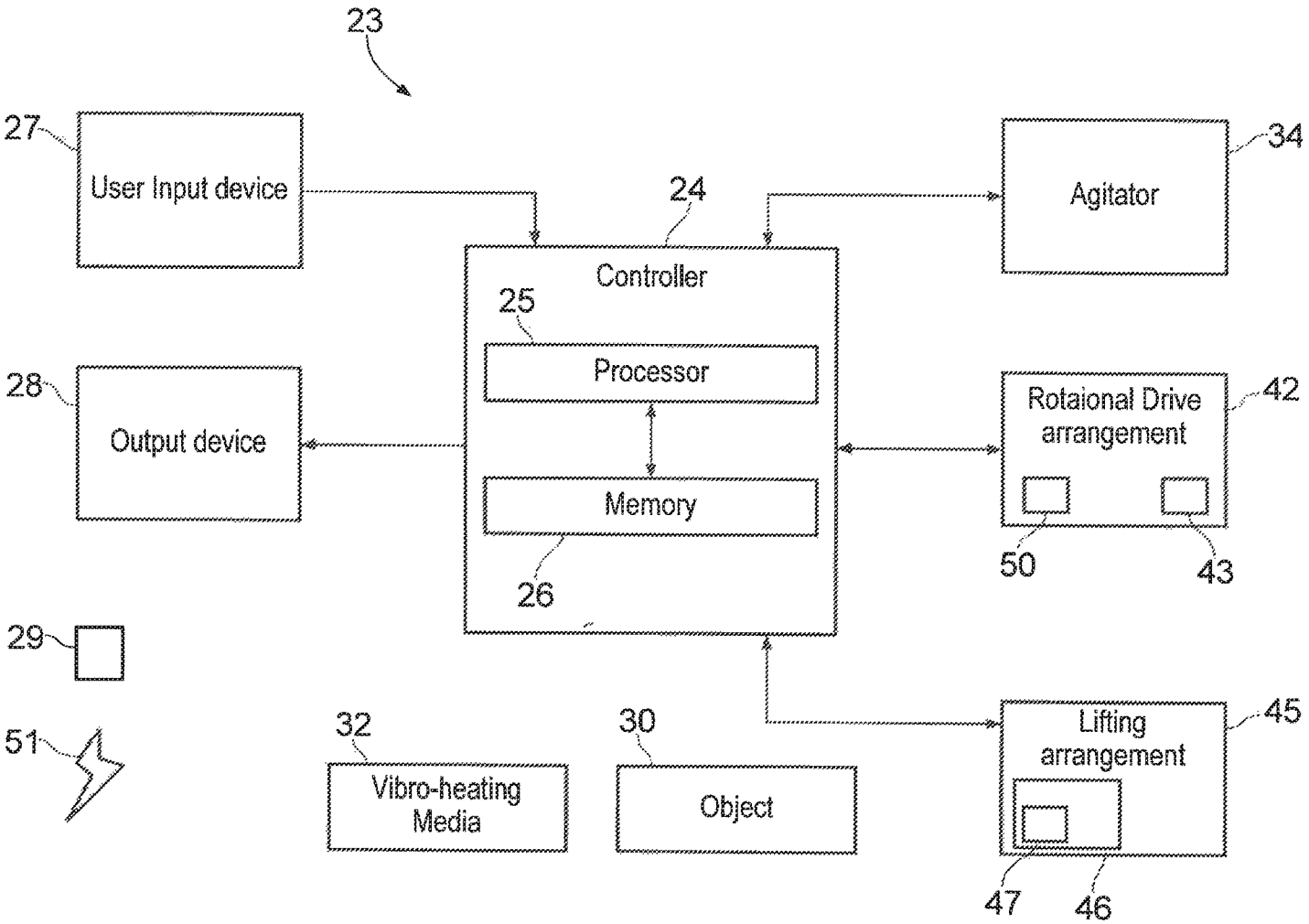
FIG. 2 illustrates a schematic diagram of an apparatus according to various examples.

FIG. 2 illustrates a schematic diagram of a vibro-treating apparatus 23 including a controller 24, a user input device 27, an output device 28, an agitator 34, a rotational drive arrangement 42, a lifting arrangement 45, an object 30 and vibro-treating media 32. In some examples, the vibro-treating apparatus 23 may be a module. As used herein, the wording 'module' refers to a device or apparatus 23 where one or more features are included at a later time and, possibly, by another manufacturer or by an end user. For example, where the vibro-treating apparatus 23 is a module, the apparatus 23 may only include the controller 24, and the remaining features may be added by another manufacturer, or by an end user.

In summary, vibro-treating apparatus 23 is configured to vibro-treat an object 30 by agitating the object 30 relative to the vibro-treating media 32. The controller 24 is configured to determine a treatment condition according to the size of the object 30, the treatment condition including an agitation condition via the agitator 34 and rate of insertion and/or withdrawal of the object 30 via the lifting arrangement 45 relative to the surface 33 of the vibro-treating media 32. The controller 24 is also configured to control the rotational drive arrangement 42 to rotate the object 30 within the vibro-treating media 32 about an axis 53 perpendicular to the surface of the vibro-treating media 32, according to the treatment condition. The treatment condition may direct the apparatus 23 to vary treatment time, that is the time period over which the object is subjected to the vibro-treating media 32, or alternatively rate of insertion or removal. The treatment condition is selected according to vibro-treating requirements and/or material characteristics to provide a substantially even vibro-treating condition over the surface area of the object 30.

The controller 24, user input device 27, output device 28, agitator 34, rotational drive arrangement 42, lifting arrangement 45, object 30 and vibro-treating media 32 may be coupled to one another via one or more wireless links and may consequently comprise transceiver circuitry and one or more antennas. Additionally or alternatively, the controller 24, user input device 27, output device 28, agitator 34, rotational drive arrangement 42, lifting arrangement 45, object 30 and vibro-treating media 32 may be coupled to one another via a wired link and may consequently comprise interface circuitry (such as a Universal Serial Bus (USB) socket). It should be appreciated that the controller 24, user input device 27, output device 28, agitator 34, rotational drive arrangement 42, lifting arrangement 45, object 30 and vibro-treating media 32 may be coupled to one another via any combination of wired and wireless links.

The controller 24 may comprise any suitable circuitry to cause performance of the methods described herein and as illustrated in FIGS. 3 to 7. The controller 24 may comprise: at least one application specific integrated circuit (ASIC); and/or at least one field programmable gate array (FPGA); and/or single or multi-processor architectures; and/or sequential (Von Neumann)/parallel architectures; and/or at least one programmable logic controllers (PLCs); and/or at least one microprocessor; and/or at least one microcontroller; and/or a central processing unit (CPU); and/or a graphics processing unit (GPU), to perform the methods.

In various examples, the controller 24 may comprise at least one processor 25 and at least one memory 26. The memory 26 stores a computer program comprising computer readable instructions that, when read by the processor 25, causes performance of the methods described herein, and as illustrated in FIGS. 3 to 7. The computer program may be software or firmware, or may be a combination of software and firmware.

The processor 25 may be located on the vibro-treating apparatus 23, or may be located remote from the vibro-treating apparatus 23, or may be distributed between the vibro-treating apparatus 23 and a location remote from the vibro-treating apparatus 23. The processor 25 may include at least one microprocessor and may comprise a single core processor, may comprise multiple processor cores (such as a dual core processor or a quad core processor), or may comprise a plurality of processors (at least one of which may comprise multiple processor cores).

The memory 26 may be located on the vibro-treating apparatus 23, or may be located remote from the vibro-treating apparatus 23, or may be distributed between the vibro-treating apparatus 23 and a location remote from the vibro-treating apparatus 23. The memory 26 may be any suitable non-transitory computer readable storage medium 29, data storage device or devices, and may comprise a hard disk and/or solid state memory (such as flash memory). The memory 26 may be permanent non-removable memory, or may be removable memory (such as a universal serial bus (USB) flash drive or a secure digital card). The memory 26 may include: local memory employed during actual execution of the computer program; bulk storage; and cache memories which provide temporary storage of at least some computer readable or computer usable program code to reduce the number of times code may be retrieved from bulk storage during execution of the code.

The computer program may be stored on a non-transitory computer readable storage medium 29. The computer program may be transferred from the non-transitory computer readable storage medium to the memory 26. The non-transitory computer readable storage medium 29 may be, for example, a USB flash drive, a secure digital (SD) card, an optical disc (such as a compact disc (CD), a digital versatile disc (DVD) or a Blu-ray disc). In some examples, the computer program may be transferred to the memory 26 via a signal 51 (such as a wireless signal or a wired signal).

Input/output devices may be coupled to the controller 24 or vibro-treating apparatus 23 either directly or through intervening input/output controllers. Various communication adaptors may also be coupled to the controller 24 to enable the vibro-treating apparatus 23 to become coupled to other apparatus or remote printers or storage devices through intervening private or public networks. Non-limiting examples include modems and network adaptors of such communication adaptors.

The agitator 34 may comprise any suitable device for vibrating the object 30 relative to the vibro-treating media 32. For example, the agitator 34 may comprise an eccentric drive means or any further means for vibrating the object 30 relative to the vibro-treating media 32. The agitation provided by the agitator 34 may be pulsed (that is, having an amplitude and/or frequency that varies over time) or may be constant (that is, having an amplitude and/or frequency that is constant over time). The controller 24 is configured to control the agitator 34 to provide a vibration.

The rotational drive arrangement 42 may comprise any suitable device for rotating the object 30 relative to the vibro-treating media 32 about either or both of an axis 53 perpendicular to the surface of the vibro-treating media 32, or an axis of the object 54. The rotational drive arrangement 42 may comprise any suitable device for rotating one or more objects 30 relative to the vibro-treating media 32 about one or more independent axes 53, 54. For example, the rotational drive arrangement 42 may comprise a motor or any further means for rotating the object 30 relative to the vibro-treating media 32. The rotational drive provided by the rotational drive arrangement 42 may be intermittent (that is, have rotational frequency that varies over time) or may be constant (that is, having a rotational frequency that is constant over time). The controller 24 is configured to control the rotational drive arrangement 42 to provide a rotation of the object 30.

The lifting arrangement 45 may comprise any suitable device for raising or lowering the object 30 relative to the surface 33 of the vibro-treating media 32. For example, the lifting arrangement 45 may comprise a lifting mechanism 46, which may comprise a motor 43 in conjunction with a lifting infrastructure or assembly, or any such further means for lifting the object 30 relative to the surface 33 of the vibro-treating media 32. The lifting of the object 30 relative to the surface 33 of the vibro-treating media 32 may be intermittent (that is, having a rate of movement—that is a unit of distance per unit of time, e.g. meters per second or m/s—that varies over time) or may be constant (that is, having a rate of movement—that is a unit of distance per unit of time, e.g. meters per second or m/s—that remains constant over time). The controller 24 is configured to control the raising or lowering of the object 30 relative to the surface 33 of the vibro-treating media 32 to enable the raising or lowering of the object 30 according to a specific rate according to a pre-determined condition.

The user input device 27 may comprise any suitable device for enabling an operator to at least partially control the vibro-treating apparatus 23. For example, the user input device 27 may comprise one or more of a keyboard, a keypad, a touchpad, a touchscreen display, and a computer mouse. The controller 24 is configured to receive signals from the user input device 27.

The output device 28 may be any suitable device for conveying information to a user. For example, the output device 28 may be a display (such as a liquid crystal display, or a light emitting diode display, or an active matrix organic light emitting diode display, or a thin film transistor display, or a cathode ray tube display), and/or a loudspeaker, and/or a printer (such as an inkjet printer or a laser printer). The controller 24 is arranged to provide a signal to the output device 28 to cause the output device 28 to convey information to the user.

The object 30 may be any article, assembly, component or part to be vibro-treated. The object 30 may be an aerospace component, or an assembly of aerospace components. For example, the object 30 may be (but is not limited to) an aerofoil, blade, disc, drum, bladed disc, bladed drum, ring or bladed ring.

The operation of the vibro-treating apparatus 23 is described in the following paragraphs with reference to FIG. 3.

Figure 3:
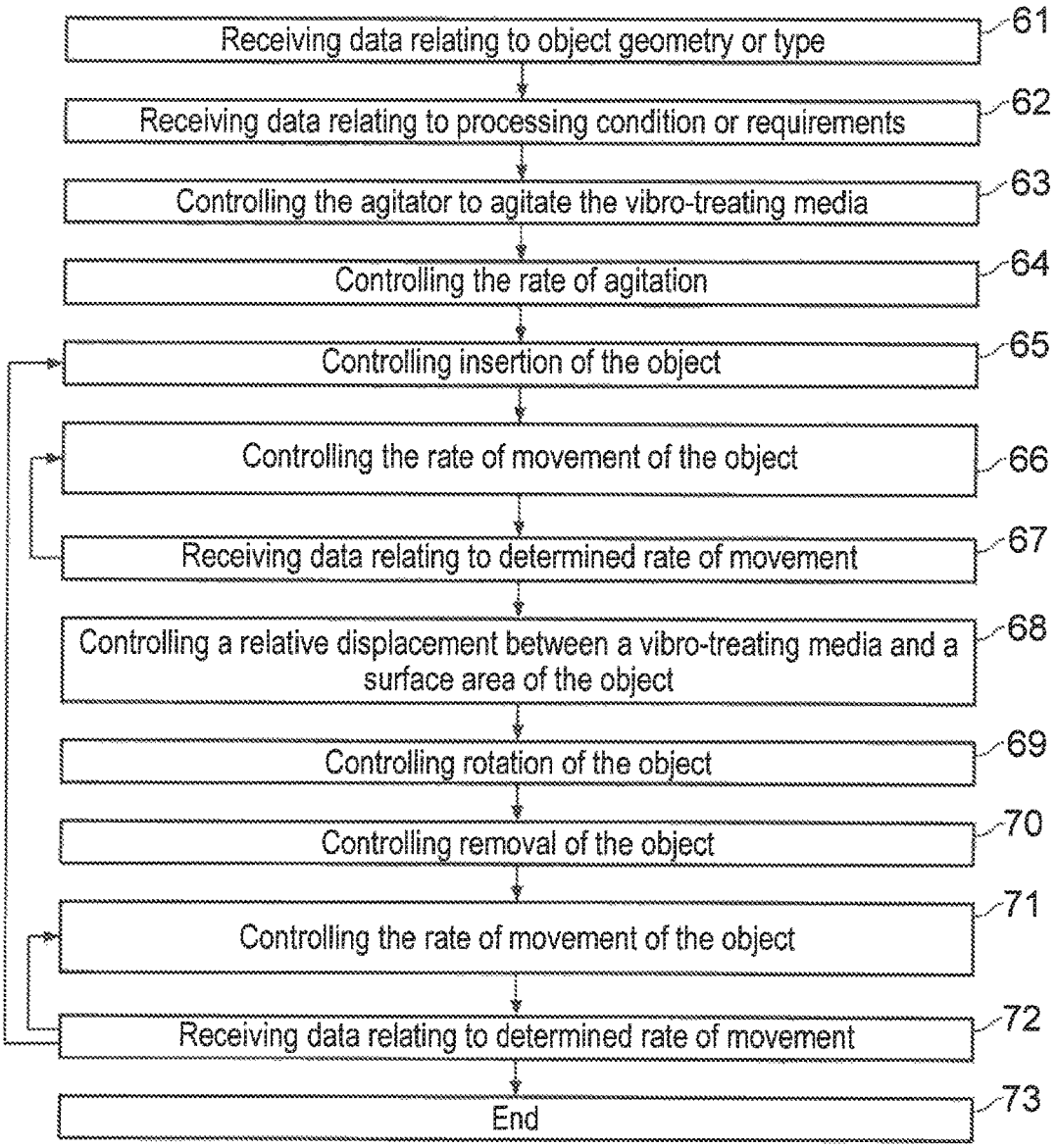
FIG. 3 illustrates a flow diagram of a method according to various examples.

FIG. 3 illustrates a flow diagram of a method according to various examples. At block 61, the method includes receiving data from the user input device 27 relating to object 30 geometry or type. For example, the controller 24 may receive data from the user input device 27 including object 30 size or geometry or pre-determined treatment conditions for the particular object 30 to be vibro-treated.

At block 62, the method may include receiving data from the user input device 27 relating to processing condition or requirements. For example, the controller 24 may receive data from the user input device 27 including process requirements or pre-determined treatment conditions for the particular object 30 to be vibro-treated. The treatment condition may direct the apparatus 23 to vary treatment time, that is the time period over which the object is subjected to the vibro-treating media 32, or alternatively rate of insertion or removal. The treatment condition is selected according to vibro-treating requirements and/or material characteristics to provide a substantially even vibro-treating condition over the surface area of the object 30.

At block 63, the method may include controlling the agitator to agitate the vibro-treating media. For example, the agitator 34 may receive data or an electronic signal 51 from the controller 24 to start or vary agitation of the vibro-treating media 32 according to requirements.

At block 64, the method may include controlling the rate of agitation. For example, the agitator 34 may receive data or an electronic signal 51 from the controller 24 to vary the amplitude or frequency of vibration with which to agitate the vibro-treating media 32 according to requirements.

At block 65, the method may include controlling insertion of the object into the vibro-treating media. For example, the lifting arrangement 45 may receive data or an electronic signal 51 from the controller 24 to vary the position of the object 30 relative to the vibro-treating media 32. Thus, the data or electronic signal 51 received from the controller 24 may alternatively be received by a lifting mechanism 46 or a lifting motor assembly 47 comprised within the lifting arrangement 45.

At block 66, the method may include controlling the rate of movement of the object 30 relative to a surface 31 of the vibro-treating media 32. For example, the lifting arrangement 45 may receive data or an electronic signal 51 from the controller 24 to vary the position of the object 30 relative to the vibro-treating media 32, wherein the rate of movement may is intermittent or constant.

At block 67, the method includes receiving data relating to determined rate of movement. For example, the lifting arrangement 45 may feed date back to the controller 24 to provide a calibration check of the actual rate of movement of the object 30 such that the controller 24 may be adjusted accordingly.

At block 68, the method includes controlling a relative displacement between a vibro-treating media 32 and a surface area of the object 30 to provide a vibro-treating effect. For example, the agitator 34 may receive data or an electronic signal 51 from the controller 24 to vary the amplitude or the frequency of vibration by which to agitate the vibro-treating media 32 according to requirements. Alternatively, or in addition, the lifting arrangement 45 may receive data or an electronic signal 51 from the controller 24 to vary the position of the object 30 relative to the vibro-treating media 32.

At block 69, the method may include controlling rotation of the object relative to the vibro-treating media. For example, the rotational drive arrangement 42 may receive data or an electronic signal from the controller 24 to vary the frequency of rotation of the object 30 relative to the vibro-treating media 32.

At block 70, the method includes controlling removal of the object 30 from the vibro-treating media by controlling rate of movement of the object relative to a surface of the vibro-treating media. For example, the lifting arrangement 45 may receive data or an electronic signal 51 from the controller 24 to vary the position of the object 30 relative to the vibro-treating media 32. Thus, the data or electronic signal 51 received from the controller 24 may alternatively be received by a lifting mechanism 46 or a lifting motor assembly 47 comprised within the lifting arrangement 45.

At block 71, the method includes controlling the rate of movement of the object 30 relative to a surface 31 of the vibro-treating media 32. For example, the lifting arrangement 45 may receive data or an electronic signal 51 from the controller 24 to vary the position of the object 30 relative to the vibro-treating media 32, wherein the rate of movement may is intermittent or constant.

At block 72, the method may include receiving data relating to determined rate of movement. For example, the lifting arrangement 45 may feed date back to the controller 24 to provide a calibration check of the actual rate of movement of the object 30 such that the controller 24 may be adjusted accordingly.

At block 73, the process may end or re-start according to requirements.

It will be appreciated that any one or more of the above blocks may feed back into any preceding step. Additionally, in such a circumstance, once a block has completed the further step, any one or more of the above blocks may jump one or more following steps according to requirements.

Various examples of the apparatus and method are described with reference to FIGS. 4 to 7. Where features are similar, the same reference numerals are used.

Shot peening is most readily described as a cold working process used to impart upon an article or object 30 a layer of compressive residual stress. It most regularly describes a process wherein an object 30 is impacted with shot (i.e. most typically round metallic, glass, or ceramic particles) with a force which is sufficient to plastically deform, and thus impart a layer of compressive residual stress on the outermost surface(s) of the article or object 30 exposed to the media. Polishing is most readily described as a process which improves or refines a surface (i.e. such that the surface finish or roughness of a surface of an article or object 30 is improved). Thus, the combined act of vibro-treating seeks to impart a layer of compressive residual stress onto the outermost surfaces of an article or object 30, whilst simultaneously improving or refining the surface(s) of the object exposed to the media.

By improving or refining the surface(s) of the object exposed to the media, the surface roughness of an outer surface of the object exposed to the media may be at least partially reduced relative to the surface roughness of the outer surface of the object prior to vibro-treating. Additionally or alternatively, by improving or refining the surface(s) of the object exposed to the media, either or both of a peak height or valley depth of an asperity or valley may be at least partially reduced relative to the peak height or valley depth prior to vibro-treating. Additionally or alternatively, by improving or refining the surface(s) of the object exposed to the media, a radius of an edge feature or a radius of an asperity or valley upon the surface may be at least partially increased relative to the radius of the edge feature, asperity or valley prior to vibro-treating.

Figure 4:
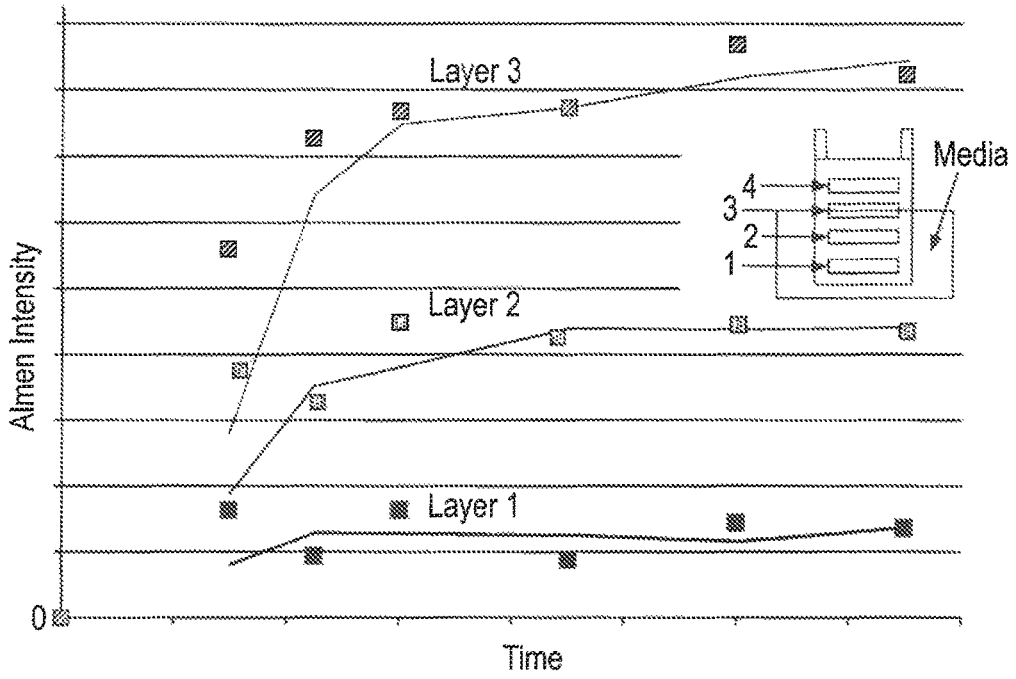
FIG. 4 illustrates a depiction of peening intensity as a function of depth and time in according to various examples.

With reference to FIG. 4, FIG. 4 shows a depiction of vibro-peen intensity as a function of the depth of the object 30 within the vibro-treating media 32 and time in accordance with the vibro-treating process. In particular, FIG. 4 shows that when the object 30 is inverted, submerged and treated within the vibro-treating media 32 according to blocks 65-58 of FIG. 3, the tip of the aerofoil or area which is deepest within the vibro-treating media 32 shown in FIG. 4 as layer 1, receives only a small extent of effective vibro-treat treatment. When fully submerged, the central region of the component 30 shown in FIG. 4 as layer 2, receives only a medium extent of effective vibro-treat treatment. The base of the aerofoil, or area closest to the aerofoil root which remains within and in an area immediately adjacent the surface 33 of the vibro-treating media 32, shown in FIG. 4 as layer 3, receives the greatest extent of vibro-treating and the highest intensity [mmA] per unit time. Accordingly, it can be seen from FIG. 4 that Almen intensity

[mmA] varies as a function of depth of the component 30 relative to the surface 33 of the vibro-treatment media 32 and/or time (minutes). This effect may be more or less pronounced depending on one or more of, for example, the shape, size or depth of the container comprising the vibro-treating media, the location of the agitator, or the wall distance between the component, container, or fixture. As such, the areas upon the surface 31 of the object 30 nearest the surface 33 of the vibro-treating media 32, such as layer 3, receive higher vibro-treating intensities per unit time than regions at greater depth relative to the surface 33 of the vibro-treating media 32—i.e. layers 2 and 1. Thus, instantaneously submerging the object 30 within the vibro-treating media 32 and extracting the object 30 after a given time according to blocks 70-72 of FIG. 3, would regularly result in a large vibro-treating intensity value near or at the top of the object 30 which has been so positioned near the surface 33 of the vibro-treating media 32, with the vibro-treating intensity falling sharply towards the tip of the object, or those regions which are furthermost from the surface 33 of the vibro-treating media 32.

To ensure substantially even and/or uniform vibro-treat vibro-treating, and hence provision of a substantially even vibro-treating condition over the surface 31 of the object 30, it is necessary, in one example, to fully submerge the aerofoil region to be treated, according to blocks 65-58 of FIG. 3, for the saturation or treatment time as required. Following the specified period of time according to blocks 68 and 69 of FIG. 3, it is then necessary to lift the aerofoil from the media 32 at a constant or variable removal rate, according to blocks 70-72 of FIG. 3, such that all regions upon the surface 31 of the aerofoil receive a substantially even vibro-treat intensity over substantially all of the surface 31 of the object 30 to be treated.

In particular, the lifting period, according to blocks 70-72 of FIG. 3, may be about equivalent to the initial saturation time. Thus the entire processing time required may be about two times that of the saturation timing. However, it will be appreciated that the removal rate may vary based on, for example, the shape, specific material, material requirements, vibro-treat media 32 and object-based considerations.

Figure 5:
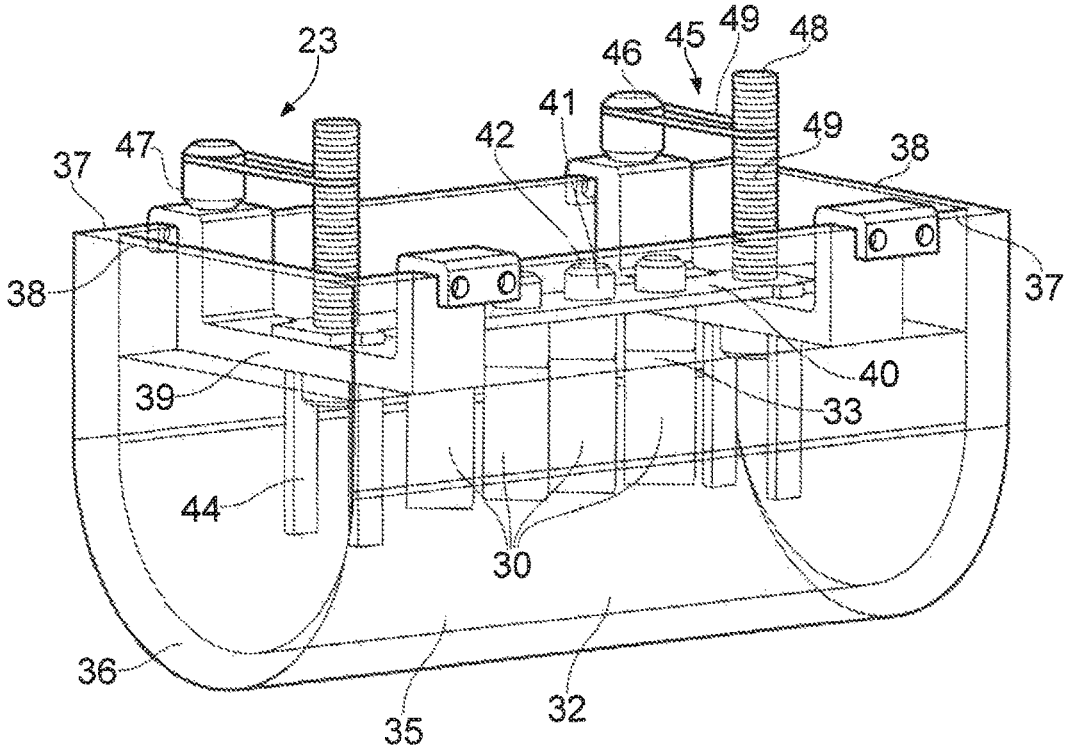
FIG. 5 illustrates a vertically arranged vibro-treating process inclusive of a support and fully lowered lifting arrangement according to various examples.

With reference to the propulsive fan 13, intermediate pressure compressor 14, and high-pressure compressor 15 as shown in FIG. 1, FIG. 5 shows a first arrangement according to various examples, wherein the combined process of polishing and shot peening is accomplished by causing a relative displacement between a vibro-treating media 32 and an aerospace object 30 such as, for example, an aerofoil. Such an aerofoil may be, for example, suitable for use within the propulsive fan 13, intermediate pressure compressor 14, and high-pressure compressor 15 according to FIG. 1, or any such further compression or turbine stage. Alternatively, according to further examples, the object 30 may be any such object or article suitable for treatment within the arrangement shown in FIG. 5.

As shown in FIG. 5, the apparatus 23 includes a container 35 suitable for holding a vibro-treating media 32. Accordingly, the depth of the container 35 is shown, in one example, to be greater than the length of the object 30 to be treated. Thus, the depth of the vibro-treating media 32 within the container 35 may be greater than the length of the object 30 to be treated. Thus, the object 30 may be at least partially submerged within the media in accordance with requirements. Referring again to the FIG. 5, in one example, the container 35 comprises a rounded base 36 to aid in the movement and circulation of vibro-treating media 32 within the container 35 and prevent areas of stagnation. It will be appreciated that in further examples, any such further shape of the base 36 may be envisaged. The container 35 is shown to comprise two opposing side walls 37 of extended length adjacent two end walls 38, the container 35 being appropriately sized for the one or more objects 30 requiring treatment at any one time. It will be appreciated that the container 35 may, in a further example, comprise a receptacle of any size or shape to allow the object 30 or aerofoil to be at least partially submerged within the vibro-treating media 32.

According to one example, in order to vibro-treat the article or object 30, the vibro-treating media 32 is displaced relative to the object 30, in accordance with block 68 of FIG. 3. The displacement may be provided by an externally or internally driven agitator 34, that is a source of eccentric or vibrational agitation about the container 35. In a further example, the object 30 may be displaced relative to the vibro-treating media 32, in accordance with block 68 of FIG. 3. Thus, the displacement may be provided by an externally or internally driven source of eccentric agitation about the object 30 or any supporting infrastructure for holding the object 30 within the vibro-treating media 32. The vibro-treating media 32 may comprise, in one example, steel media or shot, although ceramic, metallic, polymeric, composite or any such further material of appropriate hardness, size or shape may be used depending on the object 30 and specific treatment required.

In one example shown in FIG. 5, a support structure or fixture 56 may be used to support the or each object 30 relative to the container 35 and/or the surface 33 of the vibro-treating media. According to the example shown in FIG. 5, the support structure 56 comprises a pair of cross-members 39 extending between opposing side walls 37. Additionally, FIG. 5 also shows a support beam 40 extending between the two cross-members 39.

The support beam 40 is also shown to comprise one or more attachment points 41 for attaching one or more objects 30 to the beam 40. Thus, one or more objects 30 may be attached to the support beam 40. The attachment points 41 may further comprise a drive arrangement 42, which may comprise, for example a rotational drive or motor 43. As such, the rotational drive 42 may rotate one or more of the objects 30 within the vibro-treating media 32, for example, during one or more of insertion, treatment and withdrawal, in accordance with block 69 of FIG. 3. The rotational drive 42, attachment points 41 or beam 40 may further comprise a vibratory mechanism 50 for vibrating the beam 40 and/or object 30 relative to the vibro-treating media 32. In a yet further example, the drive mechanism may be excluded from the assembly, and the object 30 may be either be held in a static arrangement or allowed to freely rotate according to the natural movement of the vibro-treating media 32 during operation.

In use, the pair of cross-members 39 are arranged transversely between and connected to two planar side walls 37 of the container 35. Between the pair of cross members 39 is arranged the support beam 40, the support beam 40 comprising four rotational drive mechanisms 42, each drive mechanism 42 being connected to an attachment point 41 suitable for the connecting to and holding at least a part of an object 30. Additionally, the support beam 40 is shown to comprise four supporting rods 44. As shown in FIG. 5, two supporting rods 44 are, in one example, arranged at either end of the support beam 40. Thus, the supporting rods 44 are received within a recess formed within each cross-member 39 so as to allow the supporting rods 44 to be raised or lowered within the recess, in accordance with the support beam 40 and relative to the cross-members 39.

Also connected to the support structure 56, and in particular the cross-members 39 and support beam 40 is a lifting arrangement 45 suitable for, in use, the raising and lowering of the support structure 56 and object 30 relative to the surface 33 of the vibro-treating media 32, in accordance with blocks 65-67 and 70-72 of FIG. 3. In one example shown in FIG. 4, the lifting arrangement 45 comprises one or more lifting mechanisms 46. As such, in one example, each lifting mechanism 46 comprises a lifting motor assembly 47, each motor assembly 47 being attached to and or/interacting with a substantially vertically mounted threaded column 48 via a pulley mechanism 49. It will be appreciated that in a further example, the vertically mounted columns 48 may be angled or replaced by any such suitable means for carrying out an equivalent task.

Referring again to FIG. 5, in one example, each of threaded columns 48 are located through both a respective cross member 39 and support beam 40 such that the threaded portions 49 of each respective column 48 cooperably interacts with respective threaded portions of the support beam 40. Additionally, the position of the threaded column 84 is substantially vertical such that rotation of the threaded column 48 in a clockwise or anticlockwise direction brings about a raising or lowering of the support beam 40 relative to the column 48. As such, in use, the threaded columns 48 may be rotated by the respective lifting motors 47, so interacting with and lifting the support beam 40 and rotational drive mechanisms 42. In raising or lowering the support beam 40 and rotational drive mechanisms 42, each of the objects 30 will be raised or lowered into or out of the vibro-treating media 32.

It will be appreciated that such interaction and movement of the beam 40 may, in a further example, be alternatively provided by various means including hydraulics, pneumatics, pulleys or worm-screws, or any such similar robotic or telescopic mechanism. It may also be appreciated that in a further example, one or more arms or mechanisms may be used to provide said raising or lowering one or more objects 30 relative to the surface 33 of the vibro-treating media 32, said arm being articulated, raised or lowered by any such 1 or more axis coupling or mechanism, or any such combination of the same.

It will be appreciated that the rotational drive arrangement 42 and/or lifting arrangement 45 is, in one example, controlled via numerical control 24 or computer aided methods, but may, in an alternative example, be controlled using manual or remote methods. Furthermore, it will be appreciated that the lifting arrangement 45 and rotational drive arrangement 42 are, in a preferred example, lifted and/or rotated independently of one another. However, in some examples, it will be appreciated that such mechanisms may alternatively be geared, connected or mechanically linked to lift and/or rotate in conjunction with one another.

In further examples, it will also be appreciated that the four support rods 44 of FIG. 5 may be replaced by one or more support rods 44. It will also be appreciated that in a further example, the structure may comprise one or more containers 35, or may alternatively comprise one or more cross-members 39, support beams 40, or any such further structure suitable for the attachment and suspension of the one or more objects 30 within the vibro-treating media 32.

Figure 6:
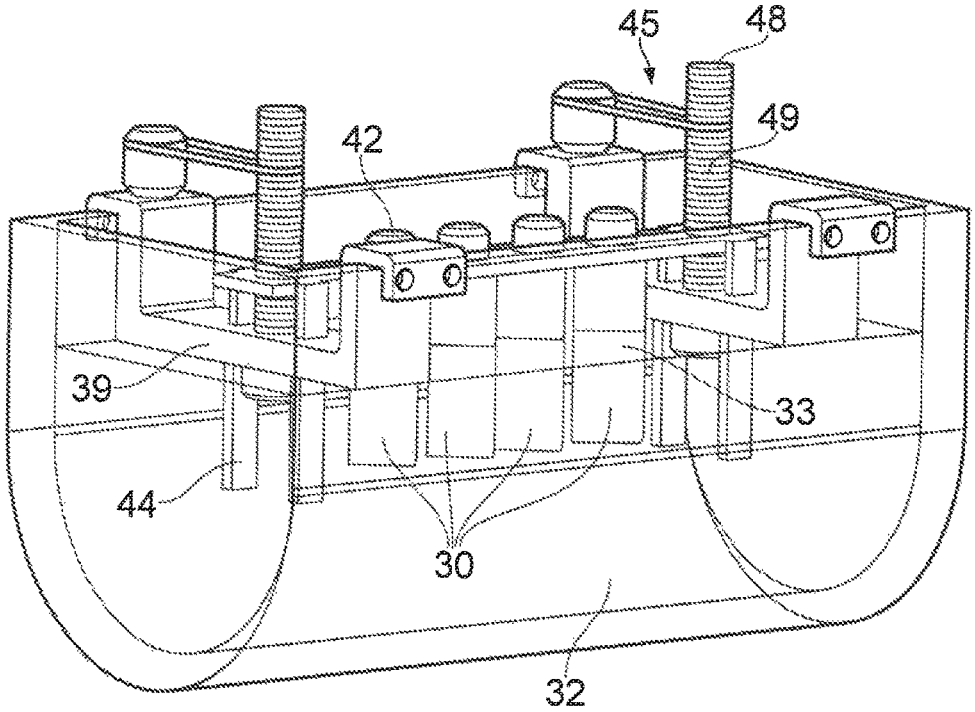
FIG. 6 illustrates a vertically arranged vibro-treating process inclusive of a support and part raised lifting arrangement according to various examples; and, FIG. 7 illustrates a vertically arranged vibro-treating process inclusive of a support and substantially raised lifting arrangement according to various examples.

With reference to FIG. 6, FIG. 6 shows the vibro-treating process as shown in FIG. 5, the lifting arrangement 45 being shown in a part-raised configuration. As shown in FIG. 6, and in order to achieve the vertical lift required to obtain the part-raised position, the lifting mechanism 46 has vertically raised the support structure 56 and object 30, inclusive of the cross-member 39, support beam 40 and supporting rods 44, such that approximately half the object 30, when the object 30 is considered in the vertically orientated direction, remains within the vibro-treating media 32.

FIG. 6 also shows that during the lifting of the support structure 56 and object 30 via rotation of the threaded column 48 relative to the support beam 40, the four rotational drive mechanisms 42 have remained static, thus ensuring that the object 30 has been prevented from twisting or rotating during insertion and/or removal from the vibro-treating media 32.

However, it will also be appreciated that the present figure is presented as an example only and that the or each lifting mechanism 46 may instead rotate the object 30 about either or both of an axis 53 perpendicular to the surface of the vibro-treating media 32, or an axis of the object 54 before or during one or more of insertion, treatment and removal into or out of the vibro-treating media 32. The rotational drive arrangement 42 may comprise any suitable device for rotating one or more objects 30 relative to the vibro-treating media 32 about one or more independent axes 53, 54.

Figure 7:
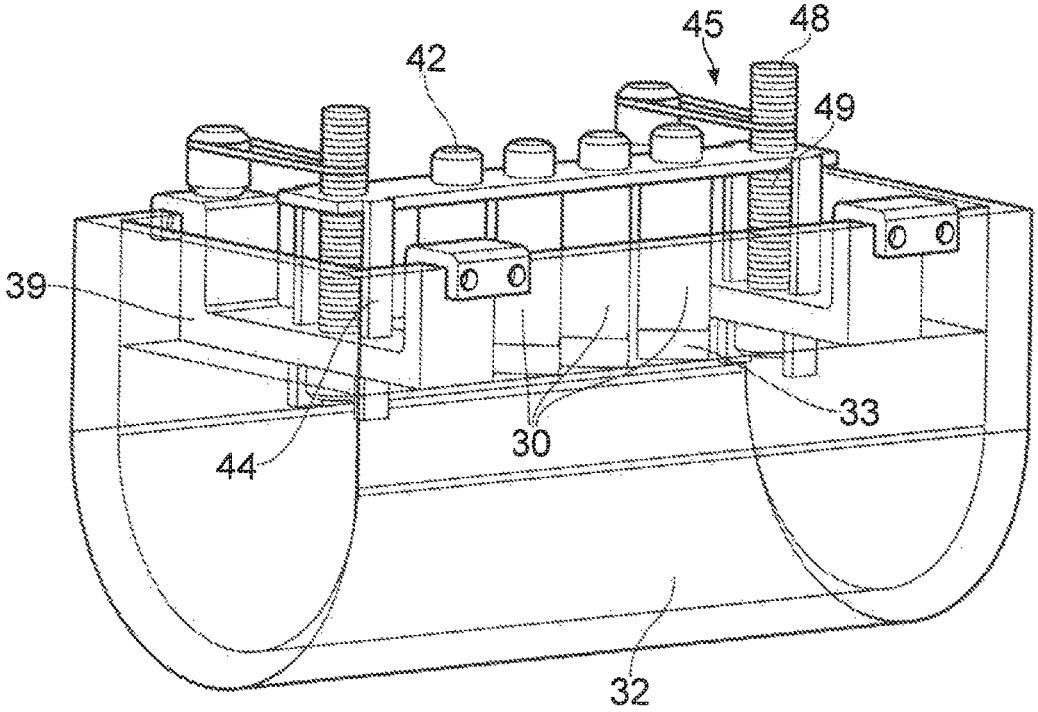

With reference to FIG. 7, FIG. 7 shows the vibro-treating process as shown in FIGS. 5 and 6, the lifting arrangement 45 being shown in the substantially raised configuration. Accordingly, FIG. 7 shows only a small portion of the object 30 remaining within the vibro-treating media 32. As referenced in FIG. 5, in order to achieve the vertical lift required to obtain the part-raised position, the lifting mechanism 46 has vertically raised the support structure 56 and object 30, inclusive of the cross-member 39, support beam 40 and supporting rods 44, to the required level. It will also be appreciated that in a preferred example, where numerical control or computer aided methods are used in order to accurately control the withdrawal of the object 30 from the vibro-treating media 32, the withdrawal rate of the object 30 from the vibro-treating media 32 may be modified in accordance with any one or more of the requirements of the user, the material or the object 30. Additionally, in a preferred example, both the lifting speed and rate of rotation may be modified in accordance with process parameters including object 30 geometry via direct operational input with the one or more of the lifting arrangement 45 or lifting mechanism 46.

It will be understood that the various examples are not limited to the embodiments above-described and various modifications and improvements can be made without departing from the concepts described herein. For example, the different embodiments may take the form of an entirely hardware embodiment, an entirely software embodiment, or an embodiment containing both hardware and software elements.

Except where mutually exclusive, any of the features may be employed separately or in combination with any other features and the disclosure extends to and includes all combinations and sub-combinations of one or more features described herein.

The invention claimed is:

1. A method of vibro-treating an object, the method comprising:

providing a vibro-treating effect that comprises imparting a layer of compressive residual stress onto a surface area of the object, the vibro-treating effect provided by controlling a relative displacement between a vibro-treating media and the surface area of the object; and providing a substantially even vibro-treating condition over the surface area of the object, the substantially even vibro-treating condition provided by controlling substantially vertical movement of the object relative to a surface of the vibro-treating media while controlling the relative displacement between the vibro-treating media and the surface area of the object, the substantially even vibro-treating condition including providing a predetermined intensity over a predetermined coverage area of the object, the predetermined coverage area being a percentage of the surface area of the object that has been vibro-treated according to one or more predetermined conditions.

2. A method as claimed in claim 1, wherein at least one of the pre-determined conditions determines a rate of movement of the object relative to the surface of the vibro-treating media.

3. A method as claimed in claim 2, wherein the rate of movement of the object relative to the surface of the vibro-treating media is continuous.

4. A method as claimed in claim 2, wherein the rate of movement of the object relative to the surface of the vibro-treating media is discontinuous.

5. A method as claimed in claim 1, wherein controlling movement of the object relative to the surface of the vibro-treating media comprises at least partially inserting the surface area of the object within the vibro-treating media.

6. A method as claimed in claim 1, wherein controlling movement of the object relative to the surface of the vibro-treating media comprises at least partially withdrawing the surface area of the object from the vibro-treating media.

7. A method as claimed in claim 5, the object being inserted and/or withdrawn from the vibro-treating media over a time period of between about 0.1 to 5 times the saturation time of the object.

8. A method as claimed in claim 5, the object being inserted and/or withdrawn from the vibro-treating media over a time period of between about 0.5 to 3 times the saturation time of the object.

9. A method as claimed in claim 1, further comprising masking at least a portion of the object to substantially prevent interaction of the vibro-treating media with the surface of the object within the masked surface area.

10. A method as claimed in claim 1, wherein controlling movement comprises controlling movement of the object relative to the surface of the vibro-treating media at an angle approximately normal to the surface of the vibro-treating media.

11. A method as claimed in claim 1, wherein the object has an axis and controlling movement comprises controlling the rotation of the object about the axis of the object.

12. Vibro-treating apparatus comprising a controller configured to:

provide a vibro-treating effect that comprises imparting a layer of compressive residual stress onto a surface area of the object, the vibro-treating effect provided by the controller controlling a relative displacement between a vibro-treating media and the surface area of the object; and providing a substantially even vibro-treating condition over the surface area of the object, the substantially even vibro-treating condition provided by the controller controlling substantially vertical movement of the object relative to a surface of the vibro-treating media while controlling the relative displacement between the vibro-treating media and the surface area of the object, the substantially even vibro-treating condition including providing a predetermined intensity over a predetermined coverage area of the object, the predetermined coverage area being a percentage of the surface area of the object that has been vibro-treated according to one or more predetermined conditions.

13. A vibro-treating apparatus as claimed in claim 12, the apparatus comprising a fixture configured to position the object relative to the surface of the vibro-treating media.

14. A vibro-treating apparatus as claimed in claim 13, the fixture being configured to alter the position of the object relative to the surface of the vibro-treating media whilst vibro-treating.

15. A vibro-treating apparatus as claimed in claim 12, wherein at least one of the pre-determined conditions determines a rate of movement of the object relative to the surface of the vibro-treating media.

16. A vibro-treating apparatus as claimed in claim 12, wherein controlling the movement of the object relative to the surface of the vibro-treating media comprises at least partially inserting the surface area of the object within the vibro-treating media.

17. A vibro-treating apparatus as claimed in claim 12, wherein controlling the movement of the object relative to the surface of the vibro-treating media comprises at least partially removing the surface area of the object from the vibro-treating media.

18. A vibro-treating apparatus as claimed in claim 16, the object being moved relative to the vibro-treating media over a time period of between about 0.1 to 5 times the saturation time of the metal or alloy.

19. A vibro-treating apparatus as claimed in claim 12, wherein controlling movement includes controlling movement of the object relative to the surface of the vibro-treating media at an angle approximately normal to the surface of the vibro-treating media.

20. A non-transitory computer readable storage medium comprising computer readable instructions that, when read by a computer, cause performance of the method as claimed in claim 1.

* * * * *